US005422464A

United States Patent [19]

Jeon

[11] Patent Number: 5,422,464

[45] Date of Patent: Jun. 6, 1995

[54] DEVICE FOR SENSING FOOD WEIGHT OF MICROWAVE OVEN

[75] Inventor: Yong S. Jeon, Seoul, Rep. of Korea

[73] Assignee: Goldstar Co., Ltd., Seoul, Rep. of Korea

[21] Appl. No.: 118,137

[22] Filed: Sep. 8, 1993

[30] Foreign Application Priority Data

Sep. 9, 1992 [KR] Rep. of Korea ..... 17295/1992

[51] Int. Cl.[6] ..... H05B 6/78

[52] U.S. Cl. ..... 219/708; 219/518; 177/210 C

[58] Field of Search ..... 219/10.55 B, 10.55 E, 219/10.55 R, 518, 708; 177/210 C

[56] References Cited

U.S. PATENT DOCUMENTS 4,825,967 5/1989 Sakamoto et al. ..... 177/210 C
4,875,533 10/1989 Mihara et al. ..... 177/210 C
4,970,374 11/1990 Ueda et al. ..... 219/518
5,050,034 9/1991 Hegner et al. ..... 361/283

*Primary Examiner*—Philip H. Leung

*Attorney, Agent, or Firm*—Fliesler, Dubb, Meyer & Lovejoy

[57] ABSTRACT

A food weight sensing device of a microwave oven using a variable capacitor of which the capacitance is varied in accordance with pressure applied thereto. The device comprises of first and second electrodes placed on a side portion of a lower surface of a cooking chamber, the side portion being included in a rotating trail of a roller applied with part of the food weight, each of the electrodes comprising a metal plate spring. A spacer is interposed between the first and second electrodes to space out the electrodes from each other at a predetermined interval. A rubber plate engages with the first electrode for transmitting the food weight to the first electrode. The first electrode comprises a center circular push part, an outer flange part and at least two arcuate ribs connecting the center circular push part to the outer flange part. The spacer is made of a metal so as to electrically connect the first electrode to a printed circuit board. This device precisely and easily senses the food weight by sensing a varied capacitance of the variable capacitor.

3 Claims, 5 Drawing Sheets

DEVICE FOR SENSING FOOD WEIGHT OF MICROWAVE OVEN

BACKGROUND OF THE INVENTION

1. Field of the Invention

The present invention relates in general to a microwave oven, and more particularly to a device for sensing and measuring, by the capacitance or the electrostatic capacity, a weight of food laid on a turntable in a cooking chamber of the microwave oven.

2. Description of the Prior Art

There have been proposed several types of devices for sensing a weight of food laid on a turntable in a cooking chamber of a microwave oven. A description for a representative example of the food weight sensing devices of the microwave ovens will be given referring to the accompanying drawing, FIG. 10.

FIG. 10 shows in a sectional view a food weight sensing device for a microwave oven according to the prior art. As shown in this drawing, the known food weight sensing device comprises a base plate 31 of a cooking chamber, the cooking chamber receiving food to be cooked, and a lower support plate 32. The weight sensing device further comprises a rubber plate 33 arid a pair of strong dielectric plates 34 and 35 orderly interposed between the base plate 31 and the lower support plate 32. Here, the rubber plate 33 is provided with upper and lower hemispherical protrusions 33*a* and 33*b* of which the upper protrusion 33*a* is inserted in a through hole 31*a* of the base plate 31.

In the drawing, the reference numeral 36 denotes a roller of a rotary ring supporting the turntable (not shown) on which the food is laid to be cooked by microwaves emitted from a magnetron (not shown) of the microwave oven.

In operation of the above food weight sensing device, when the roller 36 of the rotary ring supporting the turntable passes on the upper protrusion 33*a* of the rubber plate 33 inserted in the hole 31*a* of the cooking chamber base plate 31, the food weight is acted on rubber plate 33 and this causes the lower protrusion 33*b* of the rubber plate 33 to press down the pair of strong dielectric plates 34 and 35. A piezoelectric effect is thus caused by the strong dielectric plates 34 and 35, pressed down by the lower protrusion 33*b* of the rubber plate 33, and a capacitance is sensed by the piezoelectric effect. Hence, the weight of the food laid on the turntable is sensed and measured.

However, the above food weight sensing device for the microwave oven has a problem caused by the pair of strong dielectric plates 34 and 35. That is, the pair of strong dielectric plates 34 and 35 have different capacitances and this causes a complex peripheral circuit to be necessarily added to the construction of the microwave oven to sense the desired capacitance, nevertheless, a precise weight sensing result can not be available. Furthermore, each of the strong dielectric plates 34 and 35 has a bad heat resistance as well as a bad shock resistance due to its intrinsic characteristics.

SUMMARY OF THE INVENTION

It is, therefore, an object of the present invention to provide a food weight sensing device of a microwave oven which uses a variable capacitor of which the capacitance is varied in accordance with pressure applied thereto, and precisely and easily senses the food weight by sensing a varied capacitance of the variable capacitor.

To accomplish the above object, a device for sensing food weight of a microwave oven in accordance with an embodiment of the present invention comprises: a weight sensor being constituted by integration of first and second electrodes placed on a side portion of a lower surface of a cooking chamber, the side portion being included in a rotating trail of a roller applied with part of the food weight, each of the electrodes comprising a metal plate spring; a spacer interposed between the first and second electrodes to space out the electrodes from each other at a predetermined interval; and a rubber plate engaging with the first electrode for transmitting the food weight to the first electrode.

The first electrode comprises a center circular push part, an outer flange part and at least two arcuate ribs connecting the center circular push part to the outer flange part.

The spacer is made of a metal so as to electrically connect the first electrode to a printed circuit board.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
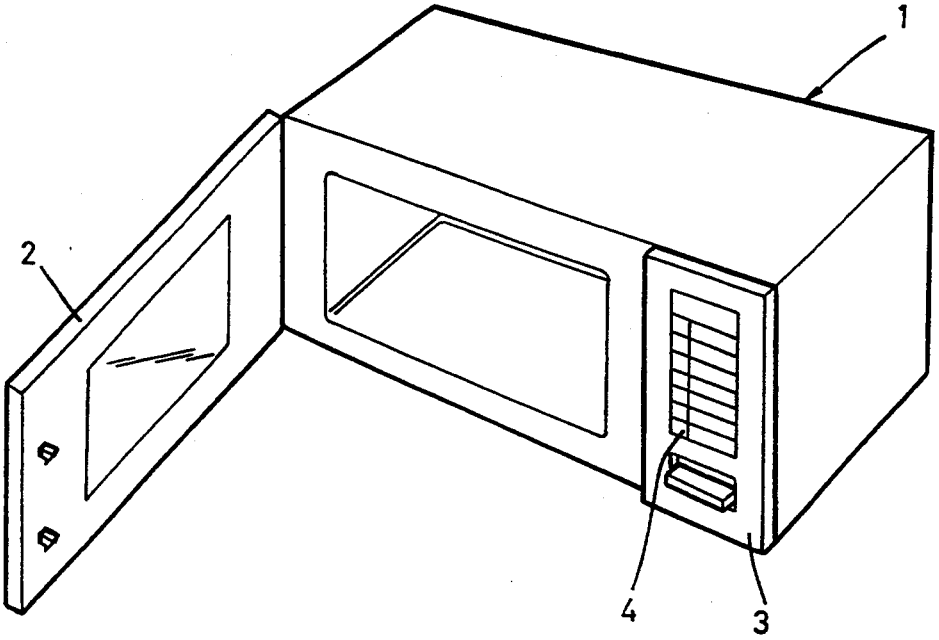
FIG. 1 is a perspective view of a microwave oven equipped with a food weight sensing device in accordance with the present invention.
Figure 2:
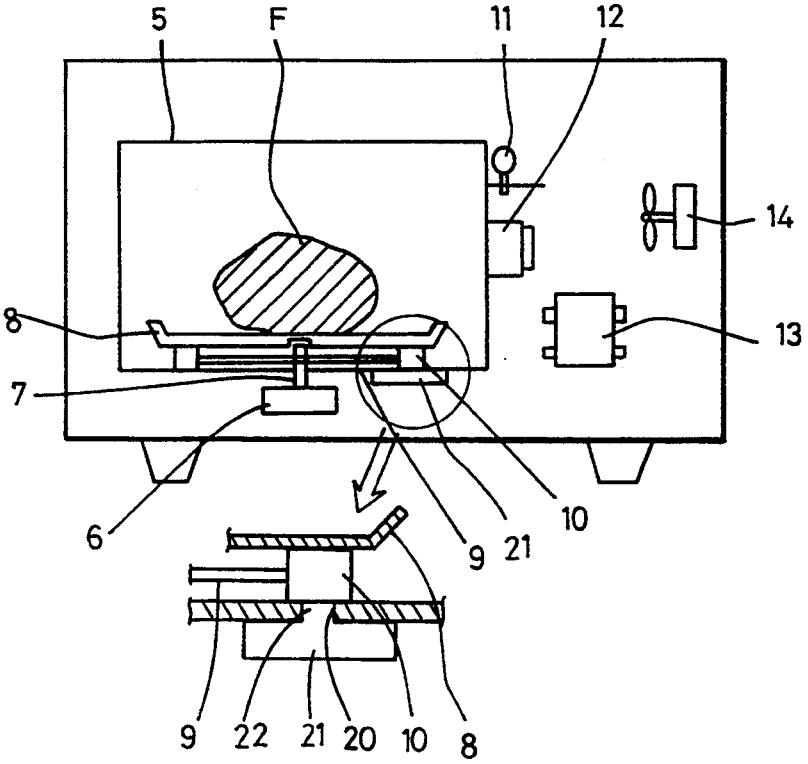
FIG. 2 is a sectional view of the microwave oven equipped with the food weight sensing device of the present invention, schematically showing a construction of the microwave oven.

With reference to FIGS. 1 and 2, there is shown in a perspective view and in a sectional view a microwave oven equipped with a food weight sensing device of the present invention. The microwave oven comprises a main casing of which the front opening is covered with an openable door 2 hinged to a side wall of the main casing 1. A front panel 3, located at a side of the front opening of the main casing 1, is provided with a control panel 4 for inputting control signals.

As shown in FIG. 2, the main casing 1 defines a cooking chamber 5 wherein the food F to be cooked is received and heated. A drive motor 6 is mounted on a lower surface of the cooking chamber 5 such that its output shaft 7 upwardly protrudes from the lower surface of the chamber 5.

A turntable 8, on which the food F to be cooked is laid, is detachably coupled to the upper top of the output shaft 7 of the drive motor 6. This turntable 8 is rotatably supported by a plurality of rollers 10 which are rotatably coupled to a rotary ring 9 such that they are spaced apart from each other at regular angles.

The microwave oven further includes a lamp 11 lighting the inside of the cooking chamber 5, and a magnetron 12 emitting microwaves to the inside of the cooking chamber 5 for heating the food F, a high voltage transformer 13. A cooling fan 14 is added to the microwave oven for serving to cool the magnetron 12, the high voltage transformer 13 and the control panel 4 as well as to expel the exhaust gas to the outside of the microwave oven.

Figure 3:
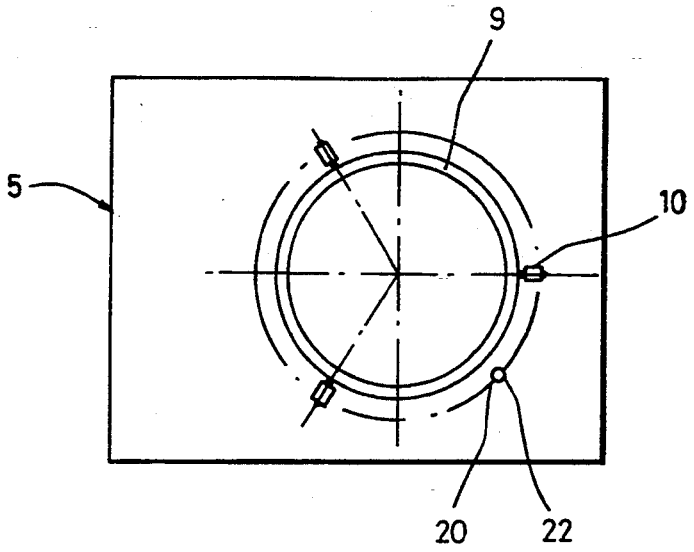
FIG. 3 is a plan view of a cooking chamber of the microwave oven equipped with the food weight sensing device of the present invention.
Figure 4:
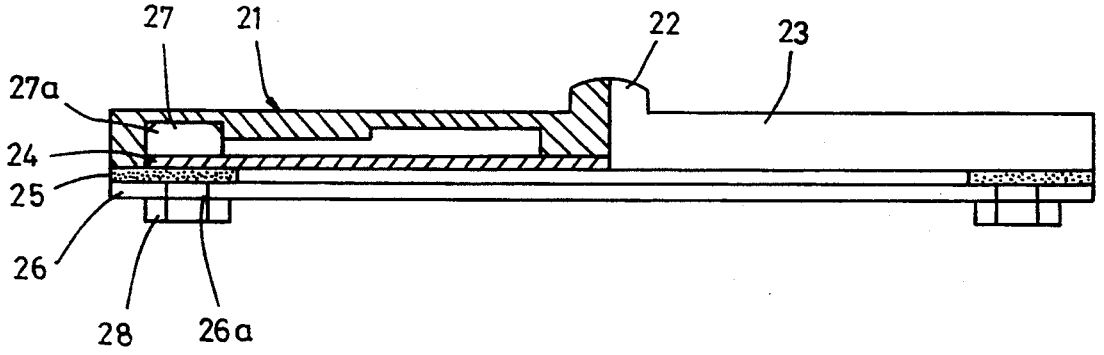
FIG. 4 is a half sectional view of the food weight sensing device of the present invention.
Figure 5:
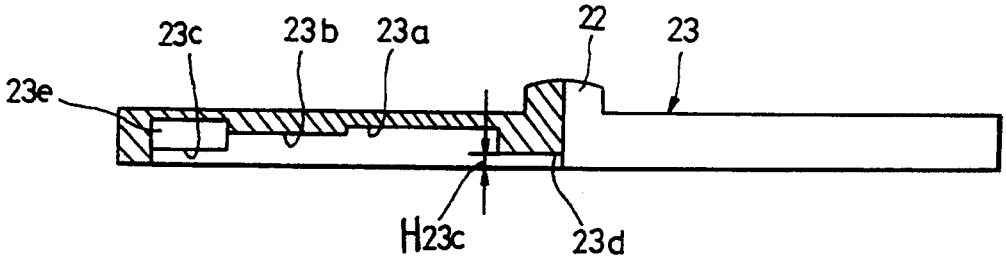
FIGS. 5 and 6 is a half sectional view of and a bottom view of a rubber plate of a food weight sensing device in accordance with an embodiment of the present invention, respectively.
Figure 6:
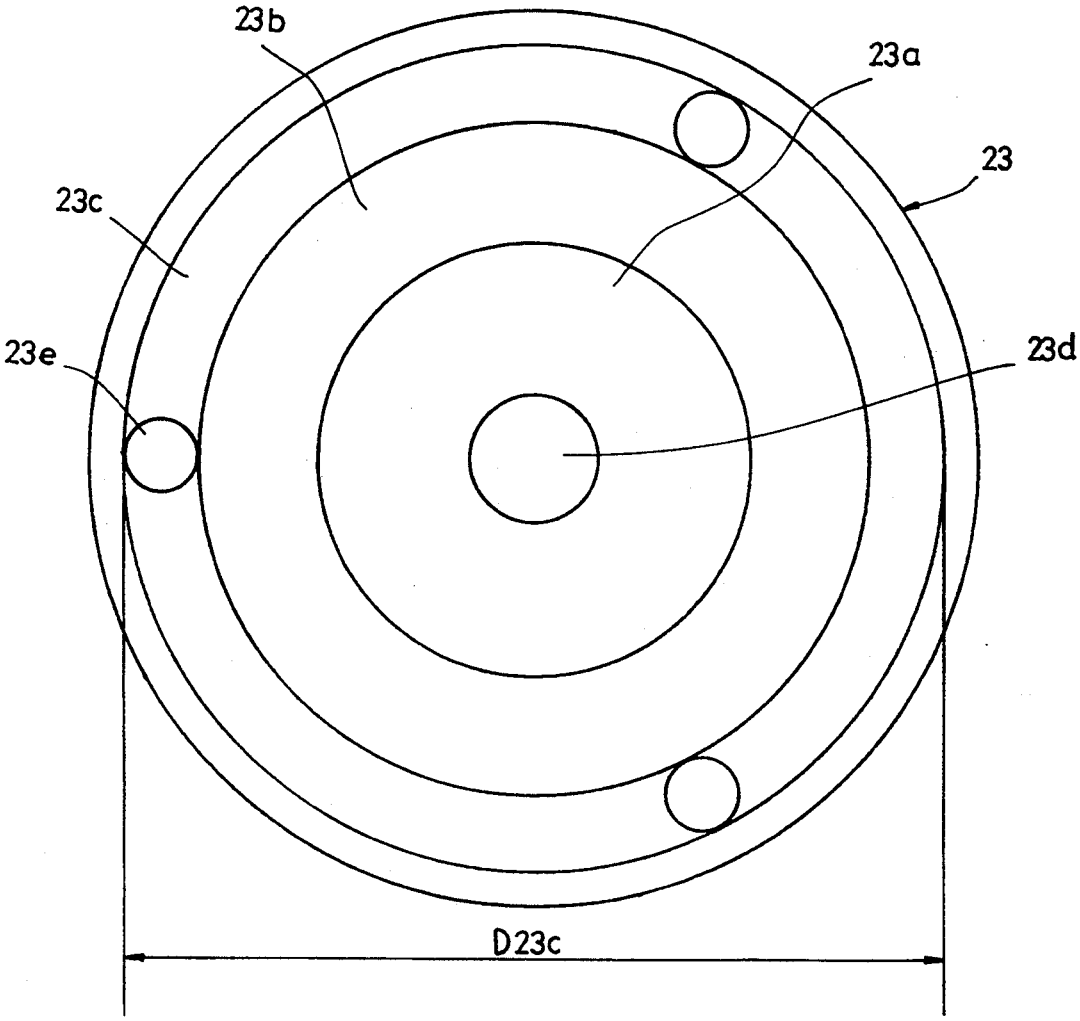
Figure 7:
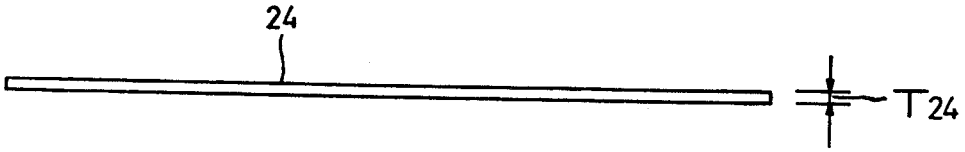
FIGS. 7 and 8 is a front view of and a plan view of a first electrode of the food weight sensing device in accordance with the embodiment of the present invention, respectively.

The microwave oven having the aforementioned conventional construction is also equipped with the food weight sensor in accordance with the present invention. As shown in FIGS. 2 to 4, in order to prepare the food weight sensing device of this invention, a through hole 20 is formed on a predetermined portion of the cooking chamber 5, that is, on a side portion of a lower surface of the cooking chamber 5. Here, the side portion of the lower surface is included in a rotating trail of the rollers 10 coupled to the rotary ring 9. A food weight sensor 21 is mounted under the lower surface of the cooking chamber 5 such that its protrusion 22 upwardly protrudes from the through hole 20 of the lower surface of the cooking chamber 5.

As shown in FIGS. 4 to 9, the food weight sensing device has a circular profile and is constituted by integration of a rubber plate 23 having an upper center protrusion 22, a first electrode 24 comprising a metal plate spring, a spacer 25, and a second electrode 26 comprising a metal plate spring.

The rubber plate 23 is provided with first, second and third concentrically stepped annular surfaces **23*a*, 23*b* and 3*c*. The third annular surface 23*c* has a height which is leveled with a center pushing protrusion 23*d* of the rubber plate 23. This third annular surface 23*c* is formed with a plurality of bolt setting holes 23*e*** which are spaced apart from each other at regular angles, for example, 270°.

Figure 8:
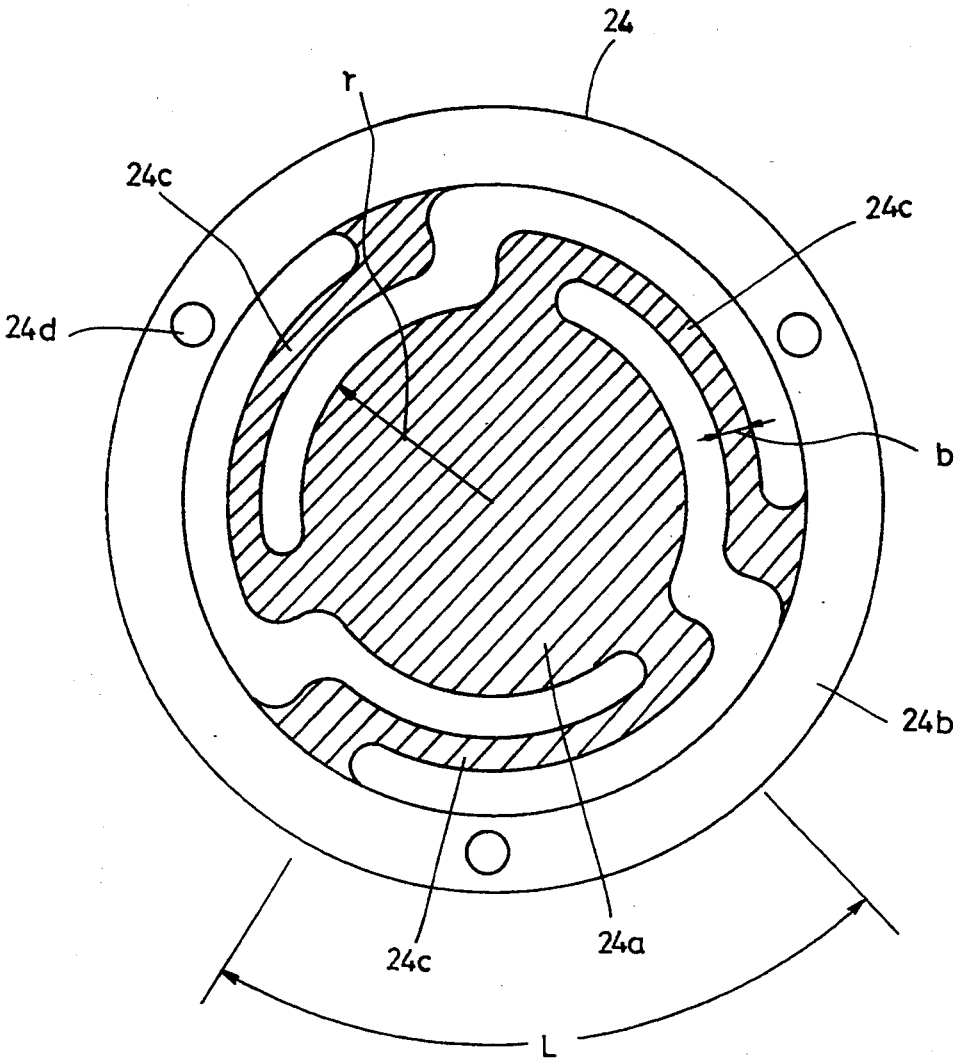
Figure 9:
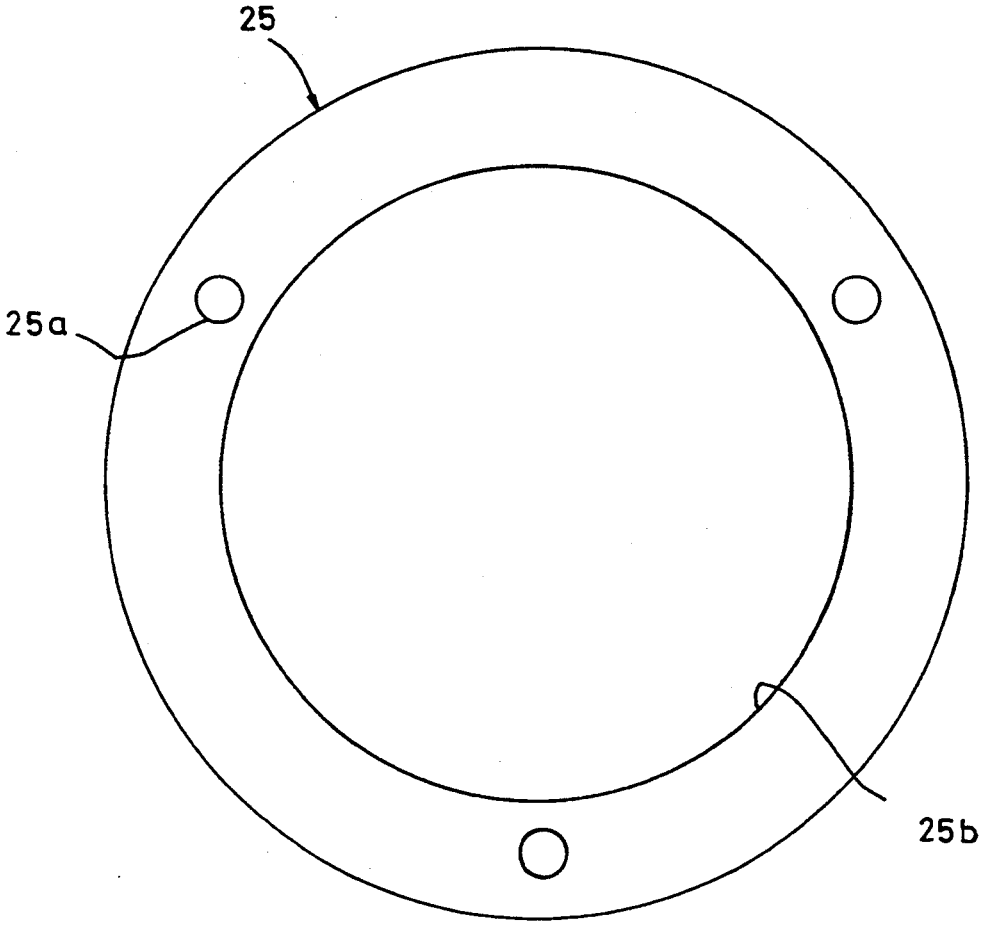
FIG. 9 is a plan view of a spacer of the food weight sensing device in accordance with the embodiment of the present invention.
Figure 10:
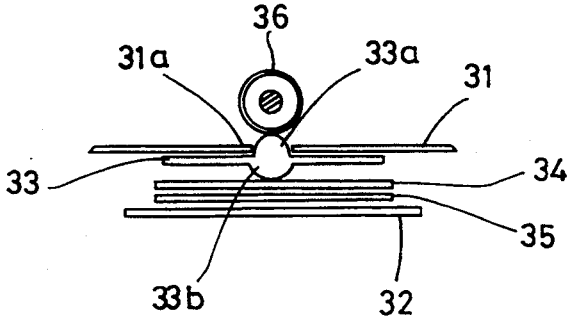
FIG. 10 PRIOR ART
FIG. 10 is a sectional view of a food weight sensing device of a microwave oven according to the prior art.

The first electrode 24 has the same diameter $D_{24}$ as an inner diameter $D_{23c}$ of the third annular surface **23*c* of the rubber plate 23. In addition, the thickness $T_{24}$ of the first electrode 24 is equal to the height $H_{23c}$ of the third annular surface 23*c*. In this regard, when the circular first electrode 24 is coupled to the rubber plate 23, it is leveled with the lower surface of the rubber plate 23 as shown in FIG. 4. As best seen in FIG. 8, a center circular push part 24*a* of the first electrode 24 is connected to an outer flange part 24*b* of the electrode 24 by a plurality of arcuate ribs 24*c*** which are placed on the same radial position and spaced apart from each other by an angular distance.

In accordance with the present invention, it is preferred to provide at least two arcuate ribs **24*c* for connection of the center circular push part 24*a* to the outer flange part 24*b***.

The radius r of the center circular push part **24*a* of the first electrode 24**, and the arcuate length L of and the width *b* of each of the arcuate ribs **24*c* are constants which are concerned with t,he displacement of the center circular push part 24*a* when an external force, or part of the food weight transmitted to the push part 24 through the rubber plate 23, is acted on the push part 24*a***.

The first electrode 24 is also provided at its flange part **24*b* with a plurality of bolt receiving holes 24*d* corresponding to individual bolt setting holes 23*e* of the rubber plate 23**.

The second electrode 26 as well as the spacer 25 interposed between the first and second electrodes 24 and 26 has the same diameter as that of the rubber plate 23. The spacer 25 and the second electrode 26 are provided with a plurality of bolt receiving holes **25*a* and 26*a*, respectively, which correspond to individual bolt receiving holes 24*d* of the first electrode 24. The spacer 25 is provided with a center opening 25*b* such that it allows the center circular push part 24*a* of the first electrode 24** to be elastically pressed down and to be received thereby.

In accordance with the present invention, it is preferred to provide at least one spacer 25 for the food weight sensing device.

In addition, the spacer 25 is made of a metal, so that it achieves a desired electric connection of the first electrode 24 to a printed circuit board (PCB, not shown) and the thickness of the spacer 25 has a close relation to the initial capacitance.

In order to assemble the above food weight sensing device of this invention, the first electrode 24, the spacer 25 and the second electrode 26 are orderly coupled to the rubber plate 23 by inserting a plurality of bolts 27, of which the heads **27*a* are inserted in and fixed to the individual bolt setting holes 23*e* of the third annular surface 23*c* of the rubber plate 23, into their bolt receiving holes 24*d*, 25*a* and 26*a*, respectively. A plurality of nuts 28 are in turn tightened to individual bolts 27, thus to completely assemble the food weight sensing device of this invention as best seen in FIG. 4**.

The operational effect of the food weight sensing device having the above construction will be given hereinbelow.

When the drive motor 6 is started under the condition that the food F having a weight is laid on the turntable 8 as shown in FIG. 2, the rollers 10 rotatably supported by the rotary ring 9 are rotated about its rotating shaft and revolves around the center of the lower surface of the cooking chamber 5 with a predetermined circular trail as shown in FIG. 3.

At this time, when a roller 10 passes on the protrusion 22 of the food weight sensing device upwardly protruding from the through hole 20 of the lower surface of the cooking chamber 5, one third of the food weight is imparted on the protrusion 22 through the roller 10 passing on the protrusion 22. Hence, the center pushing protrusion **23*d* of the rubber plate 23 of the food weight sensing device presses down the center circular push part 24*a* of the first electrode 24, thus causes a downward displacement of the push part 24*a*. This downward displacement of the push part 24*a* of the first electrode 24 causes reduction of the gap between the first and second electrodes 24 and 26**, thus to vary the capacitance.

Here, the displacement of the push part **24*a* of the first electrode 24 is proportional to the force acted on the push part 24*a*. It is thus possible to precisely sense and measure the weight of the food F laid on the turntable 8 on the basis of the relation between the force acted on the push part 24*a* and the displacement of the push part 24*a*, the relation between the displacements of the first and second electrodes 24 and 26 and the capacitance of the electrodes 24 and 26, and the relation between the force acted on the push part 24***a* and the capacitance of the electrodes 24 and 26.

On the other hand, when the roller 10 has passed the protrusion 22 of the food weight sensing device, there is no longer any weight applied to the protrusion 22. Hence, the center pushing protrusion 23*d* of the rubber plate 23 presses down the center circular push part 24*a* of the first electrode 24 no longer, thus to cause the push part 24*a* to return to its initial position owing to the elastic restoring force of the arcuate ribs 24*c*.

As described above, the food weight sensing device of a microwave oven in accordance with the present invention uses first and second electrodes, each comprising a metal plate spring, and causes a linear variation of the capacitance in accordance with physical displacements of the electrodes depending on the weight of the food applied to the first electrode, thus to precisely sense and measure the weight of the food laid on a turntable of the microwave oven. This food weight sensing device also provides advantage that it improves the heat resistance as well as the shock resistance since it uses the metal electrodes.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A microwave oven, comprising:

a cooking chamber, having a base plate for receiving and heating food;

a weight sensor including:

a first electrode, disposed beneath said base plate, having a center circular push part, an outer flange part, and at least two arcuate ribs connecting said center circular push part with said outer flange part, and a second electrode;

means, interposed between said first and second electrodes, for spacing out said first and second electrodes from each other at a predetermined interval; and a cover plate engaging with the first electrode for transmitting the food weight to the first electrode.

2. The microwave oven according to claim 1, wherein said means for spacing out said electrodes is made of a metal so as to electrically connect said first electrode to a printed circuit board.

3. The microwave oven according to claim 1, wherein said means for spacing out said electrodes comprises at least one spacer.

* * * * *